United States Patent [19]

White

[11] Patent Number: 4,480,350

[45] Date of Patent: Nov. 6, 1984

[54] SWEEPER BRISTLE

[76] Inventor: Larry F. White, 3004 S. Eaton, Denver, Colo. 80227

[21] Appl. No.: 483,038

[22] Filed: Apr. 7, 1983

[51] Int. Cl.[3] ..... A46B 13/02; A46B 7/10

[52] U.S. Cl. ..... 15/159 A; 15/55; 15/179; 15/188

[58] Field of Search ..... 15/159 R, 159 A, 179, 15/180, 182, 183, 186, 187, 188, 54, 55, 89, 91, 92; 17/11.1 R

[56] References Cited

U.S. PATENT DOCUMENTS

| | | | |
|---|---|---|---|
| 1,924,152 | 8/1933 | Coney et al. | 15/188 X |
| 2,300,157 | 11/1939 | Hunt | 17/11.1 R |
| 2,412,108 | 12/1946 | Toti et al. | 17/11.1 R |
| 3,195,175 | 7/1965 | Avery | 17/11.1 R |
| 3,411,979 | 11/1968 | Lewis, Jr. | 15/159 A |
| 4,144,610 | 3/1979 | Moore et al. | 15/159 A |
| 4,184,223 | 1/1980 | Price | 15/186 X |
| 4,282,632 | 8/1981 | Conaway | 17/11.1 R |
| 4,367,564 | 1/1983 | Holley | 15/159 A |

*Primary Examiner*—Peter Feldman

*Attorney, Agent, or Firm*—H. W. Oberg, Jr.; C. H. Castleman, Jr.; Raymond Fink

[57] ABSTRACT

A bristle for railway roadbed brooms with a trailing edge that has a plurality of spaced apart grooves that are oriented transversely of the bristle in the trailing edge portion.

22 Claims, 10 Drawing Figures

SWEEPER BRISTLE

BACKGROUND OF THE INVENTION

The invention relates to a bristle for a broom, but more particularly, the invention relates to a bristle for use in a railway roadbed broom for moving ballast.

In forming a railway road bed, a ballast of crushed rock, such as lime stone, is layered underneath and distributed around railroad ties. The ballast elevation is preferably level with or just below the railroad ties. Initial installation and normal maintenance of the roadbed requires dumping new ballast over the ties and rails supported by and above the ties. As known in the art, the ballast is redistributed from its dumped location to its desired elevation by means of a rotary broom that has a plurality of individually replaceable bristles.

Early bristles were made from nothing more than discarded lengths of wire reinforced rubber hose where a twined wire reinforcement is layered between a rubber tube and cover. An example of such a broom is disclosed in U.S. Pat. No. 3,237,232.

The harsh operating bristle environment has lead to several bristle constructions having a goal of improving the life of a bristle made from hose. U.S. Pat. No. 3,649,984 discloses a bristle having a core made of a bundle of parallel spring-steel wires that are encased in a resilient sheath. U.S. Pat. No. 4,184,223 discloses a bristle made of a solid elastomeric stem with a forward projecting knob attached at one end as a forward wearing and driving surface. U.S. Pat. No. 4,367,564 discloses a bristle with two distinct elastomeric members with a reinforcement sandwiched therebetween; the first member has a "D" shape when viewed in cross section and the second member has a "U" shape when viewed in cross section.

Not only must such bristles flex or bend rearwardly when they impact and redistribute the movable ballast above a desired roadbed elevation, the bristles are required to bend even more as they impact the immovable rails located above the ties or as they impact the immovable ties.

An object of the invention is to provide a bristle with appropriate abrasion resistant characteristics and a configuration that enhances bending for improved life.

SUMMARY OF THE INVENTION

In accordance with the invention, a bristle is provided that has a polymeric body with a leading edge portion and a trailing edge portion. The body has a plurality of spaced apart grooves that are oriented substantially transversely of the body in at least part of the trailing edge portion. The body may be integrally molded with fibrous reinforcement such as chopped rubberized fabric. Additional fibrous reinforcement may be included juxtaposed the leading edge portion or trailing edge portion.

Additional features or advantages of the invention will be apparent after reviewing the drawings and description thereof wherein.

DESCRIPTION OF PREFERRED EMBODIMENTS

Figure 1:
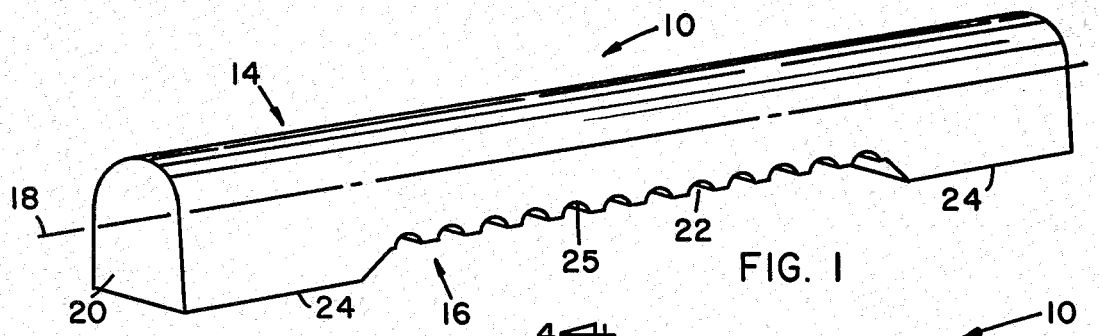
FIG. 1 is an isometric view of a bristle of the invention.

Referring to the Figures, a bristle 10 of the type for a railway roadbed broom 12 is provided that has a leading edge portion 14, a trailing edge portion 16, and a longitudinal axis 18. The bristle has a polymeric body 20 such as made with natural rubber, synthetic rubber or blends thereof; or castable materials such as polyurethane.

Figure 7:
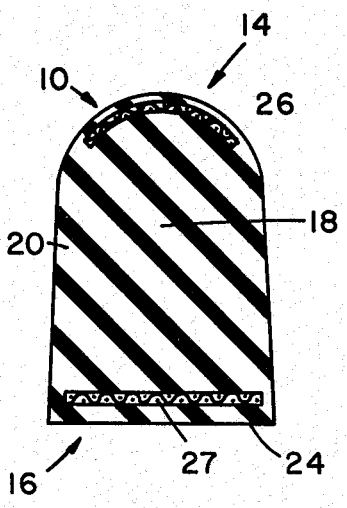
FIG. 7 is a view similar to FIG. 3 showing an alternate embodiment of the invention.
Figure 8:
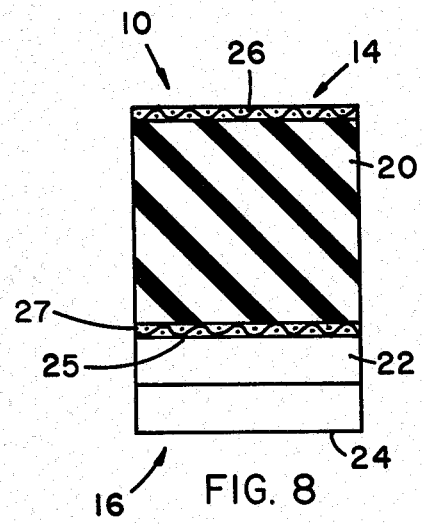
FIG. 8 is a view similar to FIG. 4 but shows an alternate embodiment of the invention.
Figure 9:
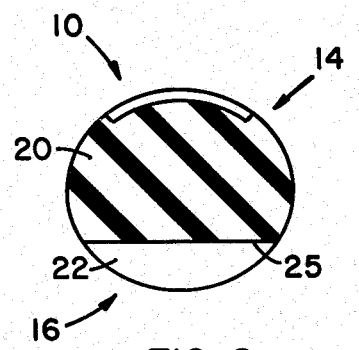
FIG. 9 is a view similar to FIG. 4 but shows an alternate embodiment of the invention.

The body may have any shape when viewed in cross section transverse to the longitudinal axis such as the "D" shape of FIGS. 1, 3, 4, and 7; rectilinear shape as shown in FIG. 8; or an oval shape such as shown in FIG. 9. The "D" section provides the body with a convex leading edge portion and a straight trailing edge portion.

A plurality of spaced apart grooves 22 are formed in the trailing edge. The grooves are oriented substantially transversely in relation to the longitudinal axis and they may be formed in any manner such as by cutting, or preferably, by integrally molding the grooves when the body is formed. If desired, the grooves may be located along the entire trailing edge, but preferably, the grooves are located over at least about 50 percent of the trailing edge portion as measured along the longitudinal axis. When the grooves are spaced from at least one end of the body, they define a concentrated mass 24 at that same end as a wearing surface.

The grooves may have any shape when viewed in cross section, and optionally, they have a concave surface portion 25 to minimize localized stresses when the bristle is bent.

The grooves are spaced apart at any convenient spacing. For example, the grooves are spaced at a constant pitch P so that the spacing C between successive grooves is less than the pitch spacing of the grooves as measured along the longitudinal axis.

Figure 2:
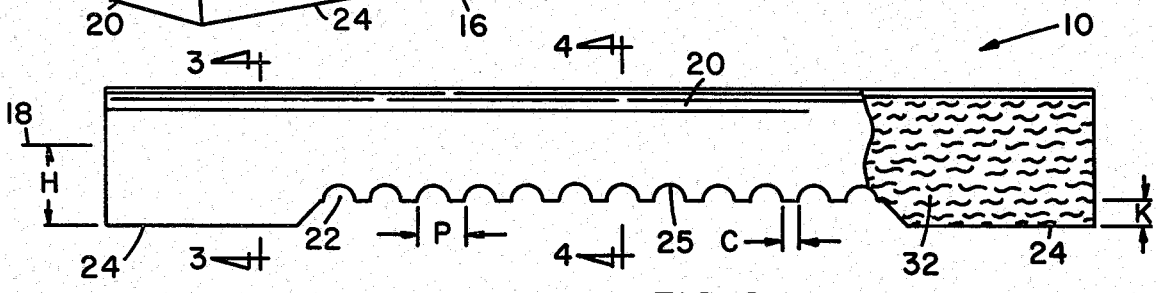
FIG. 2 is a partially cutaway side view showing some construction details of a bristle of the invention.
Figure 3:
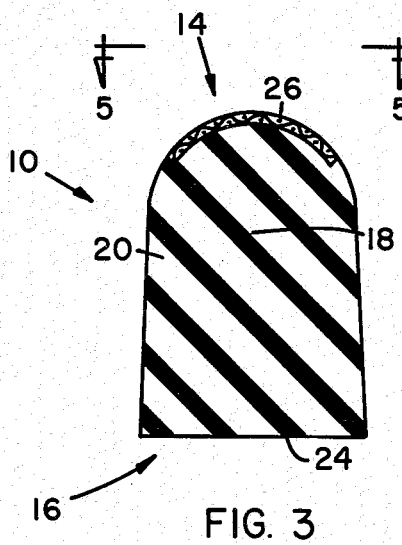
FIG. 3 is an enlarged view taken along the line 3—3 of FIG. 2.
Figure 4:
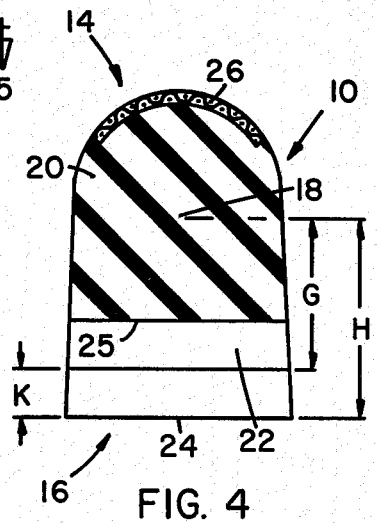
FIG. 4 is an enlarged view taken along the line 4—4 of FIG. 2.

Bristle flexibility is enhanced by spacing a trailing edge portion of the concentrated mass a greater distance H from the longitudinal axis than a distance G of trailing edge portion juxtaposed the grooves when viewed in cross section transverse to the longitudinal axis as illustrated by FIGS. 2 and 3. Such spacing leaves a rearwardly projecting concentrated mass at the trailing edge that is offset a distance K.

In another preferred embodiment, a fibrous reinforcement 26 is embedded in the bristle juxtaposed the leading edge portion. For the purpose of this disclosure, the term "juxtaposed" is used to describe a fibrous reinforcement located at the leading edge surface of the bristle as shown in FIGS. 3, 4, 8 or 9; or in a position spaced away from the leading edge surface such as shown in FIG. 7. Similarly, a second fibrous reinforcement 27 may be included in the body juxtaposed the trailing edge portion as illustrated by FIGS. 7 and 8.

Figure 5:
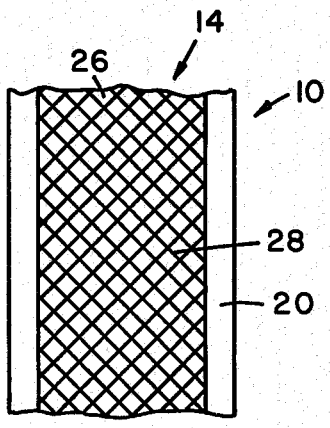
FIG. 5 is a partial view taken along the line 5—5 of FIG. 3.
Figure 6:
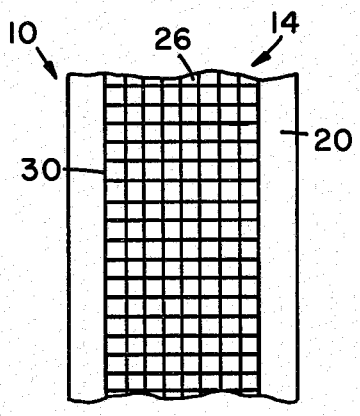
FIG. 6 is a view similar to FIG. 5 showing an alternate embodiment of the invention.

Any desired fibrous reinforcement may be used juxtaposed the leading or trailing edge surfaces. A convenient fibrous reinforcement is square woven fabric. Such fabric may be positioned relative to the bristle so that the threads forming the fabric are oriented on a bias 28 as shown in FIG. 5; or are oriented in their normal square woven state 30 as shown in FIG. 6.

Bristle abrasion resistance may be improved by dispersing a discontinuous fibrous reinforcement 32 throughout the body. Such fibrous reinforcement may be in any desired form such as discontinuous cellulosic fibers, chopped synthetic fibers, or chopped rubberized fabric. In the case of rubberized fabric, the fibers may constitute at least about 8 percent by weight of the bristle body. The chopped fabric type fibrous reinforcement may be oriented as discontinuous layers where many of which are generally parallel with the longitudinal axis or the orientation may be random.

To illustrate, a first group of bristles of the following construction were built and tested:

| Description | Description |
|---|---|
| Body | Synthetic rubber with 8 percent by weight of chopped fabric reinforcement |
| Leading Edge Reinforcement | 1¼ inch strip of .035 gauge nylon fabric |
| Length | 18 inches |
| Height | 2¼ inches |
| Width | 1¾ inches |
| Leading Edge Radius | 11/16 inches |
| Groove Radius | ¼ inch |
| Groove Pitch | 1 inch |
| Groove Spacing | 5/16 inch |
| Groove Distance From End | 3 inch |
| Groove Trailing Edge Offset | ¼ inch |

Figure 10:
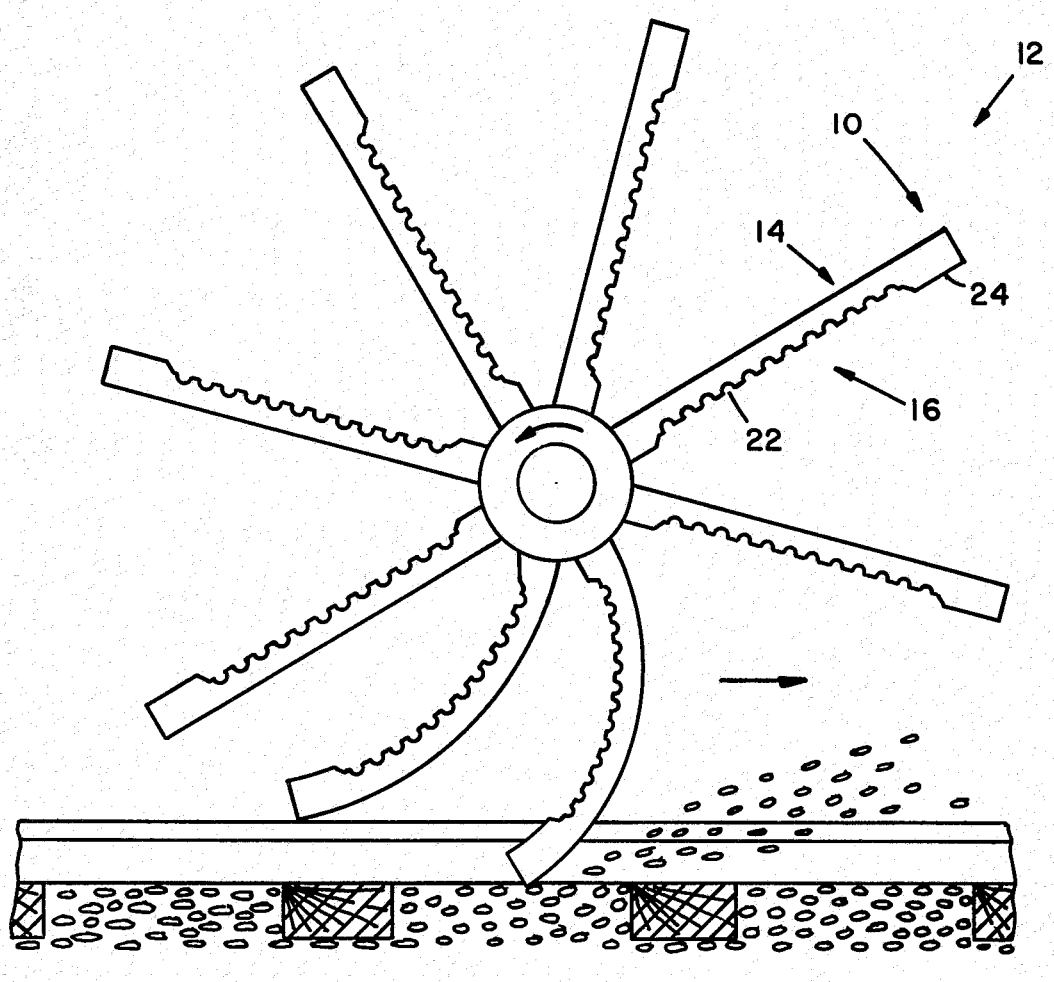
FIG. 10 is a simplified axial end view of a broom with bristles of the present invention.

A second group of bristles having the above construction but without grooves were also built and tested. Bristles of both groups were installed on a broom 12 as exemplified by FIG. 10 and were used to redistribute ballast 32 of a railway roadbed 34. Bristles of the first group lasted for approximately 14 miles of roadbed whereas bristles of the second group lasted for only 2 miles of roadbed. Thus, there was approximately a 7 fold increase in service life for those bristles having grooves in accordance with the invention.

The foregoing description is made for purpose of illustration only and is not intended to limit the scope of the invention which is to be determined from the appended claims.

What is claimed is:

1. In a bristle of the type for railway roadbed brooms and having a polymeric body with an uncorrugated leading edge portion, a trailing edge portion, ends, and a longitudinal axis, the improvement comprising:

a body having a plurality of spaced apart grooves solely in at least part of the trailing edge portion that are oriented substantially transversely in relation to the longitudinal axis.

2. The bristle as claimed in claim 1 wherein the grooves are spaced from at least one end to define a concentrated mass at the same end.

3. The bristle as claimed in claim 2 wherein the concentrated mass has a trailing edge portion that is spaced a greater distance from the longitudinal axis than a trailing edge portion juxtaposed the grooves when viewed in cross section transverse to the longitudinal axis.

4. The bristle as claimed in claim 1 wherein at least about 50 percent of the trailing edge portion, as measured along the longitudinal axis, has grooves.

5. The bristles as claimed in claim 1 wherein the grooves have concave surface portions.

6. The bristle as claimed in claim 1 wherein the grooves are spaced at substantially a constant pitch and the spacing between successive grooves is less than the pitch spacing as measured along the longitudinal axis.

7. The bristle as claimed in claim 1 which further includes a fibrous reinforcement embedded in the body juxtaposed the leading edge portion.

8. The bristle as claimed in claim 7 wherein the reinforcement is at a surface of the leading edge portion.

9. The bristle as claimed in claim 7 wherein the reinforcement is spaced from a surface of the leading edge portion.

10. The bristle as claimed in claim 7 wherein the fibrous reinforcement is a fabric.

11. The bristle as claimed in claim 7 wherein the fibrous reinforcement is a bias cut fabric.

12. The bristle as claimed in claim 1 wherein the body is integrally molded with a discontinuous fibrous reinforcement dispersed throughout at least portions of the body.

13. The bristle as claimed in claim 12 wherein the fibrious reinforcement comprises chopped fabric that constitutes at least about 8 percent of the body by weight.

14. The bristle as claimed in claim 12 wherein the body has a convex leading edge portion when viewed in cross section transverse to the longitudinal axis.

15. The bristle as claimed in claim 1 wherein the body has a substantially straight trailing edge portion when viewed in cross section transverse to the longitudinal axis.

16. The bristle as claimed in claim 1 wherein the body has an exterior "D" shape when viewed in cross section transverse to the longitudinal axis.

17. The bristle as claimed in claim 1 which further includes a fibrous reinforcement embedded in the body juxtaposed the leading edge portion.

18. A sweeper bristle comprising:

an integrally molded, generally rod shaped polymeric body with an uncorrugated leading edge portion, a trailing edge portion, ends and a longitudinal axis, the body having a plurality of spaced apart grooves solely in at least a part of the trailing edge portion that are oriented substantially transversely in relation to the longitudinal axis;

discontinuous fibrous reinforcement dispersed throughout at least portions of the body; and a fibrous reinforcement embedded in the body juxtaposed at least part of the leading edge portion.

19. The bristle as claimed in claim 14 wherein the body has a convex leading edge portion when viewed in cross section transverse to the longitudinal axis.

20. The bristle as claimed in claim 14 wherein the grooves are spaced from at least one end to define a concentrated mass at said end.

21. The bristle as claimed in claim 16 wherein the concentrated mass has a trailing edge portion that is spaced a greater distance from the longitudinal axis than a trailing edge portion juxtaposed the grooves when viewed in cross sections transverse to the longitudinal axis.

22. In a bristle of the type for railway roadbed brooms and having a polymeric body with a leading edge portion, trailing edge portion, ends, and a longitudinal axis, the improvement comprising:

a body having a plurality of spaced apart grooves in at least part of the trailing edge portion that are oriented substantially transversely in relation to the longitudinal axis; and a fibrous reinforcement embedded in the body at a surface of the leading edge portion.

* * * * *